US010772167B2

(12) United States Patent
Balkcum

(10) Patent No.: US 10,772,167 B2
(45) Date of Patent: Sep. 8, 2020

(54) WAVEGUIDE FLANGE SYSTEM

(71) Applicant: Communications & Power Industries LLC, Palo Alto, CA (US)

(72) Inventor: Adam J. Balkcum, San Jose, CA (US)

(73) Assignee: Communications & Power Industries LLC, Palo Alto, CA (US)

( * ) Notice: Subject to any disclaimer, the term of this patent is extended or adjusted under 35 U.S.C. 154(b) by 426 days.

(21) Appl. No.: 15/905,148

(22) Filed: Feb. 26, 2018

(65) Prior Publication Data

US 2019/0268980 A1 Aug. 29, 2019

(51) Int. Cl.
*H05B 6/76* (2006.01)

(52) U.S. Cl.
CPC ..... *H05B 6/76* (2013.01)

(58) Field of Classification Search
CPC ..... F16J 15/0881; H01P 1/042; H05B 6/707; H05B 6/76
USPC ..... 239/738; 333/254
See application file for complete search history.

(56) References Cited

U.S. PATENT DOCUMENTS

| | | | |
|---|---|---|---|
| 2,741,718 | A | 4/1956 | Wang |
| 3,208,758 | A | 9/1965 | Carlson et al. |
| 3,334,262 | A | 8/1967 | Nelson |
| 4,616,860 | A | 10/1986 | Faria et al. |
| 4,734,666 | A | 3/1988 | Ohya et al. |
| 4,866,346 | A | 9/1989 | Grandreau et al. |
| 4,988,130 | A | 1/1991 | Obara et al. |
| 5,196,814 | A | 3/1993 | Felker et al. |
| 5,630,592 | A | 5/1997 | Obara et al. |
| 5,700,014 | A | 12/1997 | Morita et al. |
| 6,270,045 | B1 | 8/2001 | Crawford |
| 7,775,238 | B2 | 8/2010 | Prahl et al. |

(Continued)

FOREIGN PATENT DOCUMENTS

| | | |
|---|---|---|
| CN | 103807531 A | 5/2014 |
| EP | 0459510 | 12/1991 |
| JP | 3244878 | 10/1991 |

(Continued)

OTHER PUBLICATIONS

N.C.Lasheras, Industrial technologies for RF systems in CLIC (compact linear collider), powerpoint presentation, Oct. 23, 2017, part I (pp. 1-12).

(Continued)

*Primary Examiner* — David P Angwin
*Assistant Examiner* — Nicholas A Ross
(74) *Attorney, Agent, or Firm* — CanaanLaw, P.C.; David B. Ritchie

(57) ABSTRACT

A waveguide flange system connects a pair of microwave components each having a flange attached thereto. Each flange includes a waveguide central bore, a knife edge surrounding the central bore on one side of the flange, and a weld plate extending orthogonal to the central bore in all directions. A deformable gasket is placed between the two flanges and engages the knife edges. A waveguide clamp assembly applies a uniform compressive force to clamp the flanges together to deform the gasket and to form the RF seals. The weld flanges are tack welded, the clamp removed, and the weld completed to form the vacuum seal. A venting trough through the knife edges provides a path for gasses from the region between the weld and the knife edge to vent to the central bore. The clamp may optionally be replaced after the welding for added strength and protection.

15 Claims, 6 Drawing Sheets

(56) References Cited

U.S. PATENT DOCUMENTS

| | | | |
|---|---|---|---|
| 9,581,245 | B2 | 2/2017 | Xi et al. |
| 9,699,881 | B2 | 7/2017 | Biallas |

FOREIGN PATENT DOCUMENTS

| | | |
|---|---|---|
| JP | 7024584 | 1/1995 |
| JP | 7058501 | 3/1995 |
| JP | 2001-227643 | 8/2001 |
| WO | 2016-147118 A1 | 9/2016 |

OTHER PUBLICATIONS

N.C.Lasheras, Industrial technologies for RF systems in CLIC (compact linear collider), powerpoint presentation, Oct. 23, 2017, part II (pp. 13-24).

W.R.Fowkes et al., High power RF window and waveguide componen development and testing above 100MW at X-band, SLAC-PUB-5377, Aug. 1, 1992.

K.Kitamura et al., Experimental and analytical studies on mechanical behavior of knife-edge-type metal-seal flange for fusion vacuum sealing, Journal of Vacuum Science and Technology, vol. 12, No. 6, pp. 3217-3223, Nov. 1, 1994.

P.Lutkiewicz et al., Design of a new UHV all-metal joint for CLIC (compact linear collider), Vacuum 84 (2010), pp. 289-292, Elsevier, Jan. 1, 2009.

Kurt J. Lesker Co., CF flanges technical notes (web page), Jan. 5, 2018.

wikipedia.com, Vacuum flange (Article), Sep. 28, 2017 (Revision Date).

WAVEGUIDE FLANGE SYSTEM

TECHNICAL FIELD

The present disclosure relates generally to a waveguide flange system useable to couple RF (radio frequency) waveguides and other microwave components. It is especially useful in high peak RF power environments.

BACKGROUND

Previous vacuum waveguide flange systems designed to align and connect microwave components and to carry high peak power RF energy have all had one thing in common: they use some form of knife edge in combination with some form of a crushable gasket to achieve both a vacuum and an RF seal with the same structure. One such flange (the "SLAC flange") was designed at the Stanford Linear Accelerator Center ("SLAC") and has been in worldwide use for decades. See, e.g., W. R. Fowkes, et al., "High Power RF Window and Waveguide Component Development and Testing above 100 MW at X-Band", SLAC-PUB-5877, August, 1992. FIG. 1 is a cross-sectional view of this prior art flange device having mating flanges with a copper gasket and integrated clamping mechanism. Two thick stainless steel flanges 10 (male) and 12 (female) are bolted together with a copper gasket 14 in between them to align and connect two waveguides 16 and 18. The flanges 10, 12 are designed to mate together in a plug and socket (or male and female) configuration. The plug and socket fit together tightly to provide good alignment of the waveguides. They also contain the knife edges 20, 22 that, when compressed into the gasket 14 under the action of the flange clamping hardware (bolts, nuts, washers) 24, create the RF and vacuum seals. The SLAC flange knife edges 20, 22 are angled and precisely rounded with a small radius. They are offset from one another on the mating flanges. This helps to compress and form the gasket in a large area onto both the angled and rounded surfaces of the knife edge to ensure the vacuum seal. Compression is typically 0.008" per side and is limited by a hard flange stop 26 on the flange. Compression also causes the gasket to move inward towards the interior 28 of the waveguides 16, 18. The gasket 14 is made to be slightly larger than the waveguide opening so that when it moves inward under compression it is flush or nearly flush with the waveguide surfaces. The interior 28 of waveguides 16, 18 is under vacuum in operation and is where the RF power signal 30 is carried. A more recent sexless embodiment of the flange system has been developed by the European Organization for Nuclear Research ("CERN"). See, e.g., P. Lutkiewicz, et al., "Design of a New UHV All-Metal Joint for CLIC", Vacuum, Vol. 84, pp. 289-292, 2010.

An advantage of such a flange is that it has been designed to be quickly and easily disassembled and reused. Disassembly is accomplished by loosening and removing the flange clamping hardware 24, pulling the two mating flanges 10, 12 apart and removing the now-crushed gasket 14. The flanges 10, 12 can then be reconnected by inserting a new gasket 14 and using new flange clamping hardware 24. A disadvantage of this prior art flange system is the possibility of developing vacuum leaks over time if it is subjected to thermal cycles. This could be due to heating during use (such as by passing high average RF power through it) or by high temperature processing which is commonly done to improve the vacuum conditions in systems that use such flanges. The knife edge is similar to that found on commercially available vacuum flanges, such as the "Conflat flange", that have been in use for decades. See U.S. Pat. No. 3,208,758 entitled "Metal Vacuum Joint" by Maurice A. Carlson and William R. Wheeler (Varian Associates), 1965. The manufacturer does not recommend subjecting this flange to temperatures above 400 degrees C. because of its tendency to develop vacuum leaks due to the differential expansion forces between the bolts, flange and gasket which can result in the knife edge being pulled away from the gasket. The same phenomenon occurs in the SLAC and CERN flanges and other flanges using the same principle of achieving the vacuum seal. Once a vacuum leak occurs, recompression of the gasket is usually not effective at resealing the flange for a number of reasons but mainly due to the fact that the hard flange stop 26 limits or prevents altogether any further compression.

A further disadvantage of these flanges is the need to be of a certain size to function properly. The outer dimension is controlled by the size of the waveguide to be connected, the minimum number of bolts needed to uniformly and adequately compress the gasket to achieve the vacuum seal and the minimum separation between bolts to allow for the use of tools to tighten them. The flange must also be relatively thick to withstand without distortion the large compressive force from the bolts during assembly. This results in an electrically long length for the flange interior surfaces 32, 34. These flanges must be made of a strong material which is typically stainless steel. The moderately high electrical resistivity of this material attenuates the RF power signal 30 that is being propagated in the waveguide yielding increased power losses and local heating. Propagation through a number of these connections would result in a noticeable loss of signal. Typically, these losses are greatly reduced by the application of copper plating, which has a much lower resistivity, to the flange interior surfaces 32, 34. This is usually a two-step process where the entire flange is plated first then all of the plating is stripped off except on the interior surfaces. This adds some cost to the manufacturing process and may increase the likelihood of arcing during use if the plating exhibits nodules, pitting or adherence issues.

OVERVIEW

The subject matter described herein generally relates to a waveguide flange system that can be used to connect waveguides and other microwave components. Once assembled, the flange is leak tight allowing for operation in ultra-high vacuum or with pressurized gases. The flange system is capable of passing high peak and average power RF with low losses and without arcing or sparking at the joint created.

The all-metal flange system comprises several parts: two RF sealing flanges with knife edges, a metal gasket, two vacuum sealing weld plates and a flange clamp assembly with corresponding clamping hardware (bolts, nuts, washers).

In this new flange system, the RF sealing function is separated from the vacuum sealing function by using a different set of physical features and a different mechanism for each function. The RF seal is accomplished by the action of the knife edges of each opposing flange digging into the softer gasket which is interposed between them. This creates a weak bond between the knife edge and gasket surfaces which well approximates an electrically continuous surface. The vacuum seal is accomplished by arc welding the weld plates that are attached to the two opposing flanges and which also surround both the knife edges and the gasket. Arc welding (e.g., TIG or MIG) creates a strong, very reliable and robust ultra-high vacuum seal. Separation of the vacuum seal, which is the more stringent operational function, from the RF seal allows for a simpler flange geometry, a smaller flange size and a more reliable vacuum seal compared to prior flange configurations. It also allows for greater manufacturing variances in the RF seal features and is more tolerant of rough handling.

Because the method of joining flanges together requires arc welding, this flange system is most appropriate for use in permanent or semi-permanent installations. However, by appropriate choice of flange and weld plate dimensions, the flange system may be disconnected and reconnected (i.e., by cutting and re-welding) a number of times before requiring a more extensive rework.

The foregoing overview is a summary and thus may contain simplifications, generalizations, and omissions of detail; consequently, those skilled in the art will appreciate that the overview is illustrative only and is not intended to be in any way limiting.

BRIEF DESCRIPTION OF THE DRAWINGS

The accompanying drawings, which are incorporated into and constitute a part of this specification, illustrate one or more exemplary embodiments and, together with the description of the exemplary embodiments, serve to explain the principles and implementations of the invention.

In the drawings.

DESCRIPTION OF EXAMPLE EMBODIMENTS

Figure 1:
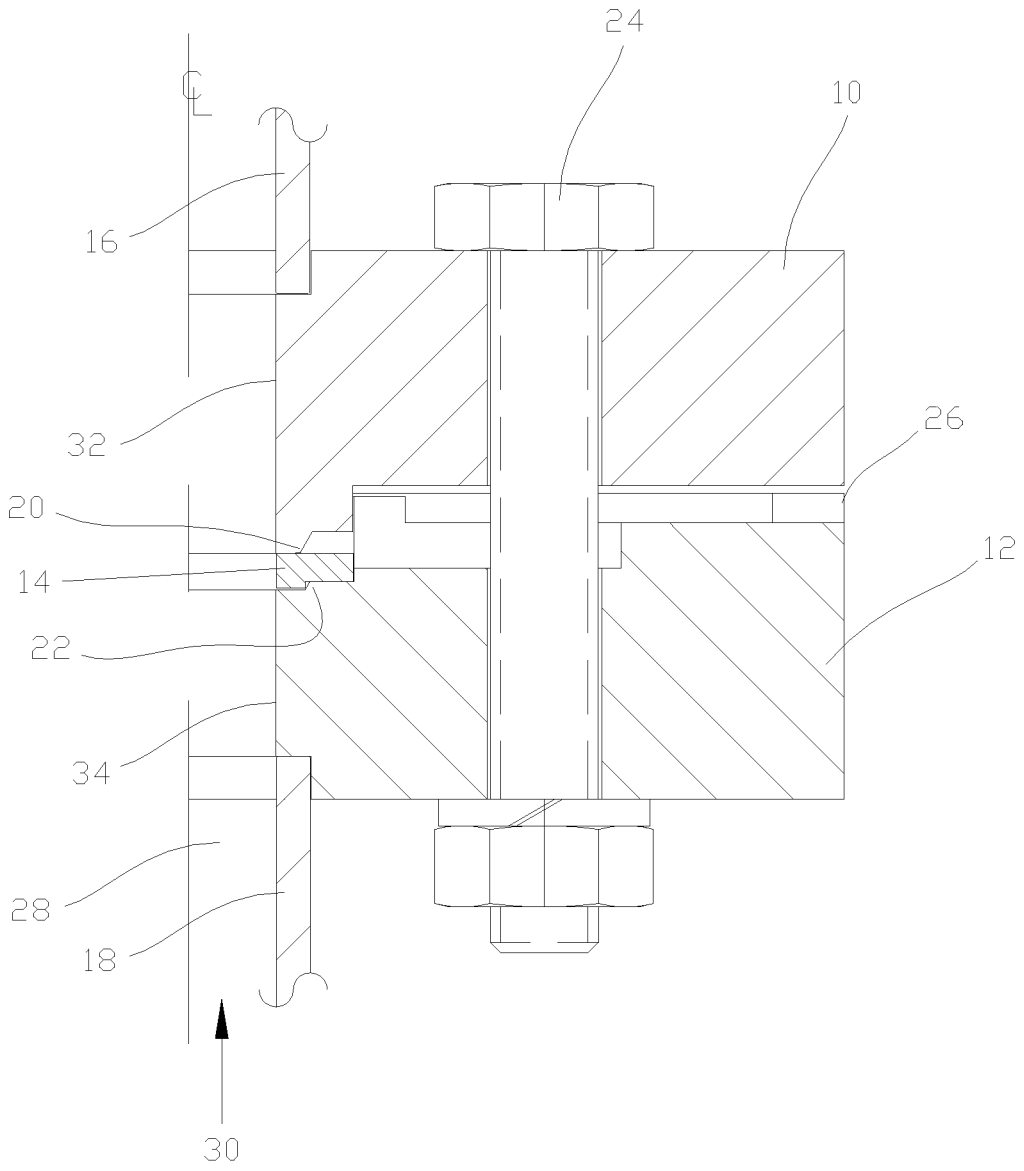
FIGURE 1 (PRIOR ART)
FIG. 1 is a cross-sectional view of a prior art waveguide flange system having mating flanges with a copper gasket and integrated clamping mechanism.

Exemplary embodiments are described herein in the context of a waveguide flange system. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the exemplary embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

References herein to "one embodiment" or "an embodiment" or "one implementation" or "an implementation" and the like means that a particular feature, structure, part, function or characteristic described in connection with an exemplary embodiment can be included in at least one exemplary embodiment. The appearances of phrases such as "in one embodiment" or "in one implementation" and the like in different places within this specification are not necessarily all referring to the same embodiment or implementation, nor are separate and alternative embodiments necessarily mutually exclusive of other embodiments.

In accordance with this disclosure, the components and process steps described herein may be implemented using various techniques without departing from the scope and spirit of the inventive concepts disclosed herein.

What is described here includes examples of the embodiments of the present invention. It is, of course, not possible to describe every conceivable combination of components or methodologies for purposes of describing the claimed subject matter, but it is to be appreciated that many further combinations and permutations of the subject innovation are possible. Accordingly, the claimed subject matter is intended to embrace all such alterations, modifications, and variations that fall within the spirit and scope of the appended claims. Moreover, the above description of illustrated embodiments of the subject disclosure, including what is described in the Abstract, is not intended to be exhaustive or to limit the disclosed embodiments to the precise forms disclosed. While specific embodiments, examples and implementations are described herein for illustrative purposes, various modifications are possible that are considered within the scope of such embodiments and examples, as those skilled in the relevant art can recognize.

In particular and in regard to the various functions performed by the above described components, devices, systems and the like, the terms used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter.

In addition, while a particular feature of the subject invention may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Figure 5:
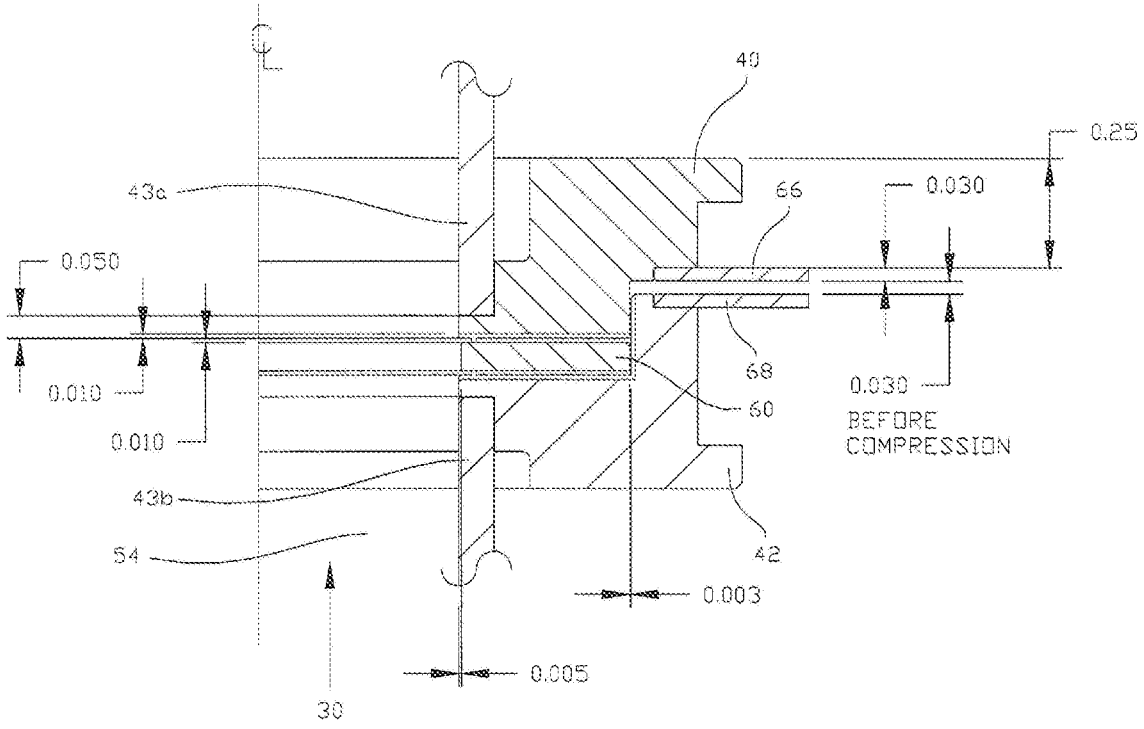
FIG. 5 is a dimensioned drawing showing typical dimensions (in inches) before compression for a rectangular version of an embodiment suitable for use in X-band.

Turning now to the figures, this section discusses design considerations of this new waveguide flange system to ensure its proper functioning. Reference is also made to FIG. 5 which shows typical dimensional values for some of the flange system features before compression when employed to connect standard X-band (approximately 8.0-12.4 GHz) rectangular waveguide. Those of skill in the art will be able to make appropriate dimensional adjustments to these features for use with other geometric embodiments (e.g., circular or ridged waveguide) and/or other frequency bands by following the guidelines set forth herein.

Figure 2:
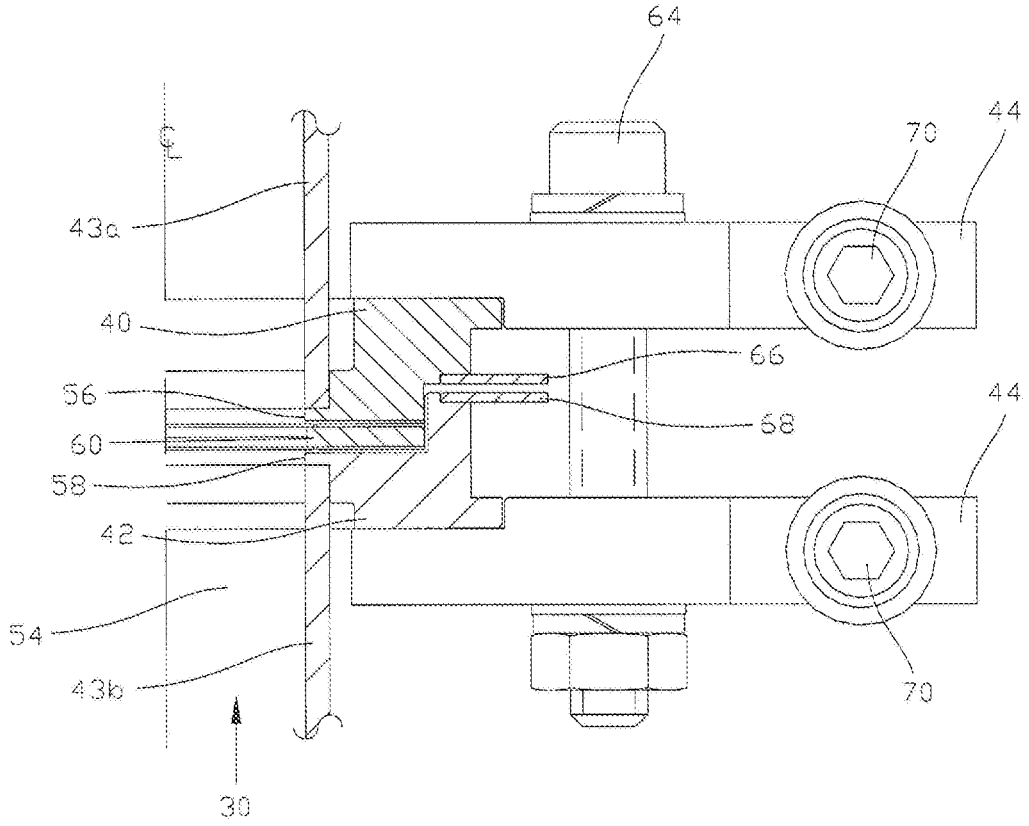
FIG. 2 is a cross-sectional view of the waveguide flange system before compression in accordance with an embodiment showing mating flanges, gasket, weld plates and removable flange clamp assembly.
Figure 3:
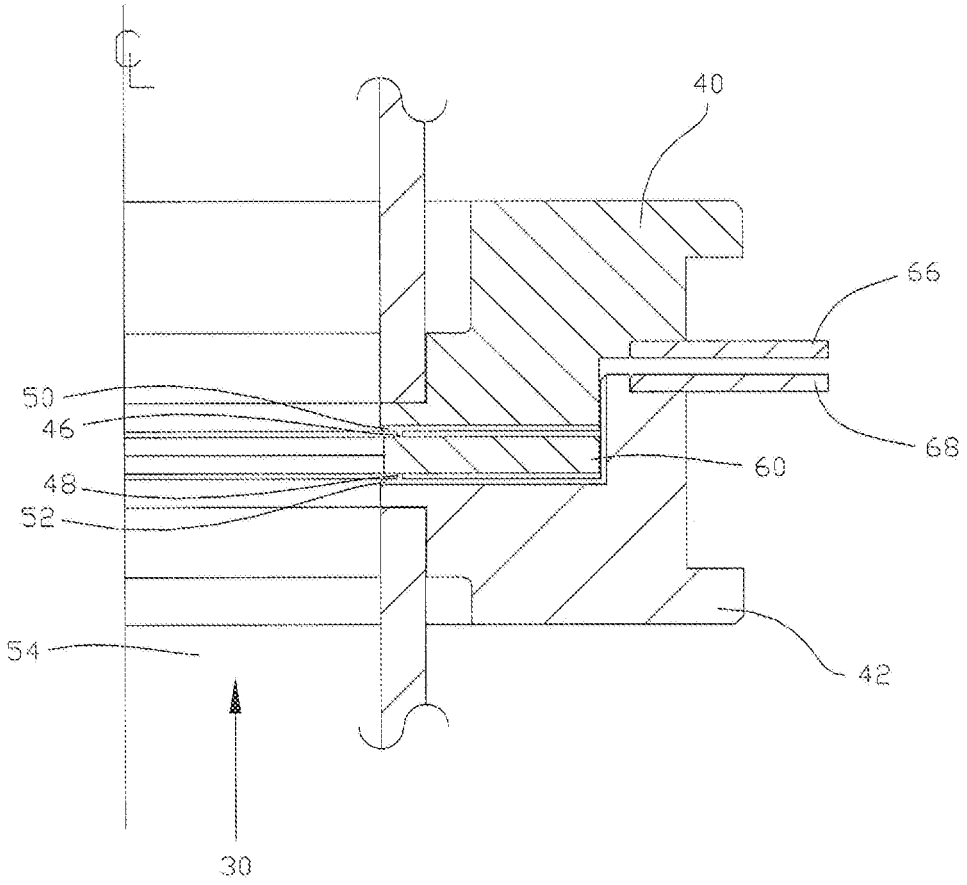
FIG. 3 is a close-up cross-sectional view of the waveguide flange system before compression in accordance with an embodiment with the clamps omitted showing the details of the knife edges, vents and gasket.
Figure 4:
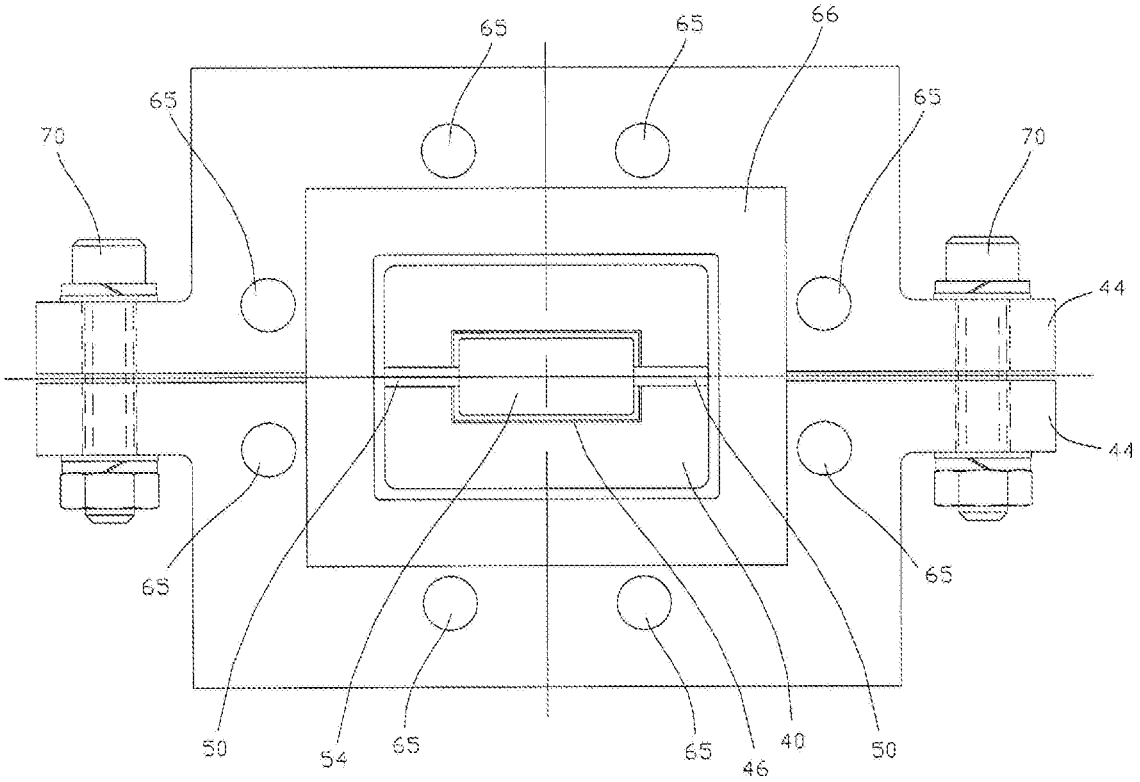
FIG. 4 is an end view of the waveguide flange system in accordance with an embodiment showing the male flange with clamp and details of the knife edge and vent.

FIG. 2 is a cross-sectional view of the waveguide flange system before compression in accordance with an embodiment showing mating flanges, gasket, weld plates and removable flange clamp assembly. FIG. 3 is a close-up cross-sectional view of the waveguide flange system before compression in accordance with an embodiment with the clamps omitted showing the details of the knife edges, vents and gasket. FIG. 4 is an end view of the waveguide flange system in accordance with an embodiment showing the male flange with clamp and details of the knife edge and vent.

The waveguide flange system includes two flanges 40, 42 (one of which may be male and the other female, or identical flanges may be used as discussed below). Each waveguide flange is attached to a microwave component such as, for example, a waveguide transmission section, a cavity, a directional coupler, a mode converter, a filter, a measurement instrument, and the like. The waveguide flanges 40, 42 surround the waveguide 43*a*, 43*b* through which RF flows. The waveguide 43*a*, 43*b* includes a central bore 54 (sometimes referred to herein as a central waveguide bore or waveguide interior) which has a cross-sectional shape depending upon the type of waveguide. In FIG. 4, for example, the central bore is shown as rectangular. Other shapes are known and may be substituted herein such as, for example, ridged rectangular waveguide, circular waveguide, oval waveguide, and the like. A two-part flange clamp assembly 44 holds the two waveguide flanges together and may be adapted to hold the entire assembly to a rigid fixture for added structural integrity.

Flanges 40, 42 should be made out of a strong material like steel or stainless steel. They should also be thick in the vicinity of the flange clamp assembly 44 to resist distortion during the clamping process. For instance, a minimum thickness of 0.25" may be used for X-band applications as shown in FIG. 5. Smaller thicknesses can be used in higher frequency bands because the bolt size used for the clamps will likely be smaller and so the clamping force will be less. Similarly, larger thicknesses should be used in lower frequency bands because larger bolts will likely be used and the clamping force will be greater.

The knife edges 46, 48 are machined directly as a projection on the flanges 40, 42 extending on the side facing gasket 60 in the direction of gasket 60 so that they engage gasket 60 upon compression of flange clamp assembly 44. As described previously, a knife edge having a simple square in cross-section is adequate to achieve the RF seal. It is also simple to machine and therefore less costly than prior approaches. If desired, the more complicated knife edge of the SLAC flange could be used instead as could the knife edge from commercially available vacuum flanges such as the Conflat flange. Regardless of which style knife edge is used, there must be at least one venting trough (vent) 50, 52 that cuts through the respective knife edge to vent the volume beyond the knife edge to the interior of the waveguide 54. The vents 50, 52 are placed where the RF electrical currents are minimal to avoid arcing or sparking across the joint. In this way, gasses trapped by welding the weld plates 66, 68 together to form the vacuum seal may be evacuated through vents 50, 52 to the central bore of the waveguide 54 so that when the waveguide is evacuated those trapped gasses will be removed. The knife edges 46, 48 are set back from the interior surfaces of the flanges 56, 58 and waveguides 43*a*, 43*b* by a small distance to ensure that they do not distort the copper gasket in the vicinity of the waveguide interior but are still close enough to minimize the distance that the RF current must flow to bridge the joint and RF seal created by the knife edges 46, 48 and gasket 60. A typical size for the knife edges 46, 48 for X-band is 0.010" wide by 0.010" high. In this case it is set back 0.020 to 0.030" from the waveguide joint. In this case the venting troughs 50, 52 are typically 0.100" wide by 0.010" deep.

The length of the flange interior surface 56, 58 that is exposed to the high-power RF is minimized to reduce RF power losses and heating and thereby provides a highly efficient, low loss method of joining waveguides and microwave components. Because of this, no special low loss coating (such as a copper plating) need be applied to the flange interior surfaces 56, 58. This simplifies the manufacturing process of the waveguide flange system and reduces its cost. It also eliminates the potential for arcing if the low loss coating is not nearly perfect due to nodules, pitting or adherence issues. However, the length of the flange interior surfaces 56, 58 in the vicinity of the joint must also have a minimum thickness to ensure its strength. This makes it resistant to distortion during both the machining process when being manufactured and the clamping process when connected to another flange. In this case a typical flange interior surface length for X-band is 0.050".

The flange interior surfaces 56, 58 may have a small chamfer or radius at the joint to reduce the electrical field gradients. This helps prevent arcing at the joint. The gasket 60 similarly has a small chamfer or radius at its inner dimension to reduce electrical field gradients. Typical values in X-band are 0.003 to 0.010".

The gasket 60 is disposed between the flanges 40, 42 and compressed thereby. It is fabricated from a metal with low hardness and yield strength that can somewhat flow around and weakly bond to the knife edge. High purity, oxygen free copper is commonly used. It is annealed to achieve a ¼ to ½ hardness rating before use. The thickness must be sufficient to resist distortion during manufacture and handling and tearing during use. A commonly used range is 0.040 to 0.080". The gasket 60 may also be thinly coated to resist sticking to the flanges 40, 42 allowing for easy removal. Common coatings are silver, carbon and titanium with thicknesses of ten to hundreds of Angstroms.

The alignment mechanism between flanges 40, 42 must be sufficiently tight to minimize the tilting of the flanges 40, 42 relative to each other during the clamping process and to provide precise alignment of the microwave components being connected. Tilting results in pulling the knife edges 46, 48 away from gasket 60 which could increase the likelihood of arcing at the interface of the flange with the gasket. The height of the knife edge does allow for some small amount of tilting before losing sufficient contact with gasket 60. In a plug and socket configuration of the rectangular flange, the gap distance between the plug outer dimension and the socket inner dimension is typically 0.003" for X-band. This minimizes tilting but is also large enough to allow for easy assembly. Uniform clamping is achieved by tightening the flange clamp assembly hardware 64 through a plurality of corresponding approximately evenly spaced bolt holes 65 in flange clamp assembly 44 using, e.g., a star pattern to apply a uniform compressive force. This approach also minimizes tilting and ensures a good RF seal. Besides a plug and socket configuration, other example embodiments of the aligning features include precision dowel pins (at least two), sets of rails that are oriented perpendicular to one another and fit into corresponding slots in the mating flange, or an external (optionally removeable) fixture that aligns the exterior features of the flanges 40, 42. The use of pins or an external fixture has the added benefit that the flanges 40, 42 can be identical so that only one flange type need be made for the entire system.

The inner dimension of the gasket 60 is slightly larger than the inner dimension of the waveguide that is being connected. The gap created by this difference in dimensions is referred to as the set back. This allows for the inward movement of the gasket 60 (squeezing) under the action of the knife edges 46, 48 and compressive clamping force during assembly. It also allows for the small uncertainty in the position of the gasket 60 within the flange 40, 42 due to the small gap distance between the outer dimension of the gasket 60 and the inner dimension of the receiving flange. This gap is necessary for easy insertion. By careful choice of all of these dimensions, the net result is that the gasket 60 will not protrude into the waveguide interior 54 after the flange has been completely assembled. Such protrusion of the gasket 60 could increase the electrical mismatch (voltage standing wave ratio) and increase the electrical gradients which could lead to arcing at the interface of the flange with the gasket. In this case a typical set back for X-band is 0.005".

The clamping force on the RF seal (to engage knife edges 46, 48 with gasket 60) is provided by the flange clamp assembly 44 and corresponding flange clamp assembly hardware (bolts, nuts, washers) 64 and also by the weld plates 66, 68 after welding. Weld plates 66, 68 need to be made of a strong material such as stainless steel to provide adequate clamping force. Weld plates 66, 68 must be separated by an adequate distance to allow for the knife edges 46, 48 to fully engage (dig into) gasket 60 during compression which creates the RF seal. After full engagement, there must still be a gap between weld plates 66, 68 so that after welding them together, they exert an axial force on the joint created by the knife edge and gasket. This helps ensure the RF seal. If done properly, the clamps can be removed without affecting the quality of the joint. A typical separation between weld plates 66, 68 after full engagement of the knife edges 46, 48 is 0.010 to 0.020". If smaller than that, there is not adequate clamping force provided by the weld. If larger than that, it is more difficult to achieve a quality weld. Weld plates 66, 68 must also be of a certain thickness. They must be thick enough to be of a minimum strength but they also should be thin enough to be somewhat flexible to make the welding process easier. Typical thicknesses are 0.020 to 0.040". The weldable lengths of the plates must also be of a minimum length to allow for multiple welds. This makes the flanges reusable. A length of 0.25" would typically allow for three to five welds.

The welding is typically performed using MIG or TIG welding techniques. Generally, the weld plates 66, 68 will first be tack welded together with the flange clamp assembly 44 in place and tightened down thus locking in the alignment and creating the RF seal first. Because the flange clamp assembly 44 blocks some areas on the weld plates 66, 68 that need to be welded, the flange clamp assembly 44 is then removed and the weld completed. The flange clamp assembly 44 may then be replaced and retightened if desired for the particular application. The resulting welded flange is vacuum tight and can be used in an evacuated system or a system pressurized with a non-reactive dielectric gas such as $N_2$, $CO_2$, $SF_6$ and the like.

Flange clamp assembly 44 needs to be made of a strong material such as steel or stainless steel and be of sufficient thickness to resist distortion during the clamping process. The clamp thickness would typically be 0.25" minimum. The clamps would typically have a counterbore feature that engages with a projected feature on the outside of the flanges 40, 42. This helps to align the opposing clamps and eases the installation and use. The clamps will typically be split in half and joined by bolts 70 in order to fit over the flanges 40, 42 and be easily removable for the welding process. The flange clamp assembly bolts 64 must also be sized appropriately tp provide adequate clamping force. For example, in X-band applications, ¼×28 bolts would typically be used.

The above described waveguide flange system may be reused several times by cutting the weld at the weld plates 66, 68, replacing gasket 60, and rewelding the weld plates 66, 68. This approach to achieving a vacuum seal is more robust against vacuum leaks than previous approaches. It also permits processing at higher temperatures for improved vacuum conditions during operation and is tolerant to large numbers of thermal cycles without vacuum leaks developing. Because of this, reprocessing after venting the vacuum in the system can be done reliably without the need to break open each flange connection and replacing gaskets in each waveguide flange connection within the system.

The waveguide flange system can be made smaller than previous systems thus simplifying manufacture and reducing costs. Because the flange clamp assembly 44 and corresponding bolts 64 are used just to make the RF seal, which is a less stringent operating condition than the vacuum seal, fewer bolts can be used resulting in the flange clamp assembly 44 being smaller. The flange clamp assembly 44 can also be removed once the weld plates are welded completely together leaving just the flanges 40, 42 and weld plates 66, 68 to define the size of the waveguide flange assembly during operation and use. The smaller size can allow for use of this flange system where the larger prior art systems may not be practical due to size constraints.

The method of making the RF seal and the RF seal itself being a less stringent operating condition allows for greater manufacturing variances and imperfections in the features associated with the RF seal function. For instance, small scratches and dents in the knife edges 46, 48 which could occur from rough handling do not affect their performance, whereas similar imperfections on the SLAC flange knife edges 20, 22 would likely render the flange unusable due to their need to both hold vacuum as well as make a good RF seal. Similar imperfections on the weld plates 66, 68 also do not affect their vacuum seal function as the imperfections can simply be welded over and repaired at the time of assembly.

Figure 6:
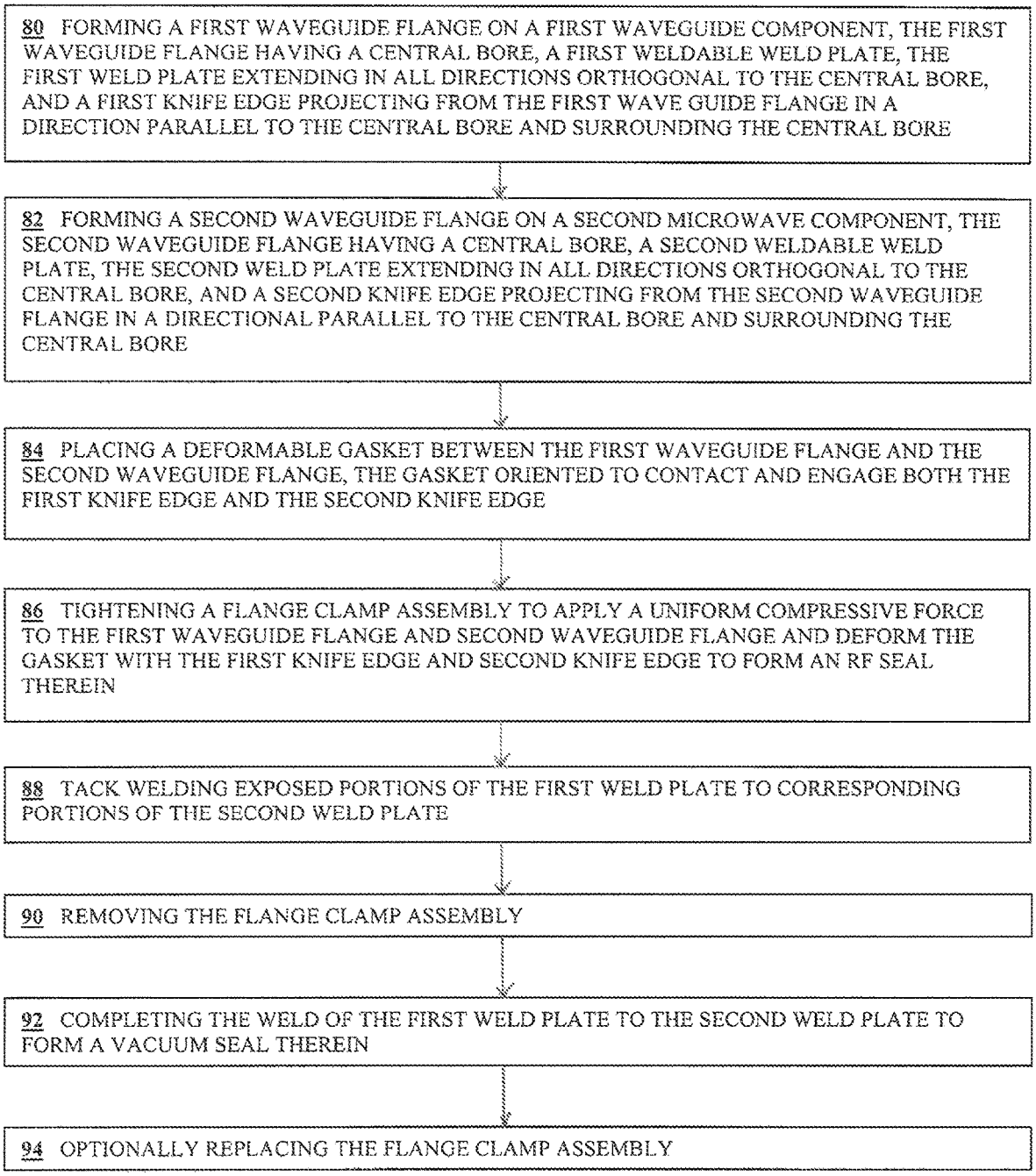
FIG. 6 is a process flow diagram illustrating a method for fabricating the waveguide flange system.

FIG. 6 is a process flow diagram illustrating a method for fabricating a waveguide flange system as described above. In accordance with FIG. 6, a method in accordance with the above-described approach includes: forming a first waveguide flange on a first microwave component, the first waveguide flange having a central bore, a first weldable weld plate, the first weld plate extending in all directions orthogonal to the central bore, and a first knife edge projecting from the first waveguide flange in a direction parallel to the central bore and surrounding the central bore 80; forming a second waveguide flange on a second microwave component, the second waveguide flange having a central bore, a second weldable weld plate, the second weld plate extending in all directions orthogonal to the central bore, and a second knife edge projecting from the second waveguide flange in a direction parallel to the central bore and surrounding the central bore 82; placing a deformable gasket between the first waveguide flange and the second waveguide flange, the gasket oriented to contact and engage both the first knife edge and the second knife edge 84; tightening a flange clamp assembly to apply a uniform compressive force to the first waveguide flange and second waveguide flange and to deform the gasket with the first knife edge and second knife edge to form an RF seal therein 86; tack welding exposed portions of the first weld plate to corresponding portions of the second weld plate 88; removing the flange clamp assembly 90; completing the weld of the first weld plate to the second weld plate to form a vacuum seal therein 92; and optionally replacing the flange clamp assembly 94.

While exemplary embodiments and applications have been shown and described, it would be apparent to those skilled in the art having the benefit of this disclosure that numerous modifications, variations and adaptations not specifically mentioned above may be made to the various exemplary embodiments described herein without departing from the scope of the invention which is defined by the appended claims.

What is claimed is:

1. A waveguide flange system for coupling a first microwave component to a second microwave component, the system comprising:

a first waveguide flange attached to the first microwave component, the first waveguide flange having a central waveguide bore;

a second waveguide flange attached to the second microwave component, the second waveguide flange having a central waveguide bore;

a deformable gasket disposed between the first waveguide flange and the second waveguide flange;

a first weldable weld plate extending outward from the first waveguide flange in all directions orthogonal to the waveguide bore;

a second weldable weld plate extending outward from the second waveguide flange in all directions orthogonal to the waveguide bore and oriented parallel to the first weld plate;

a knife edge formed in the first waveguide flange surrounding the waveguide bore on a side facing the gasket and arranged to project towards and engage the gasket; and a knife edge formed in the second waveguide flange surrounding the waveguide bore on a side facing the gasket and arranged to project towards and engage the gasket, wherein the first weld plate and the second weld plate are welded to one another to form a vacuum tight seal.

2. The system of claim 1, further comprising:

a flange clamp assembly arranged to contact the first waveguide flange and the second waveguide flange and apply a uniform compressive force clamping them together, the flange clamp assembly including two clamp portions, the first clamp portion arranged to engage with the first waveguide flange, the second clamp portion arranged to engage with the second waveguide flange, the first and second clamp portions each having a plurality of aligned bolt holes through which a plurality of bolts may be fitted to apply a compressive force to the two clamp portions thereby forming an RF seal between each flange and the gasket at the knife edges.

3. The system of claim 2, wherein the gasket comprises copper.

4. The system of claim 3 wherein at least one of the first microwave components is a waveguide transmission section.

5. The system of claim 3 wherein at least one of the first microwave components is a cavity.

6. The system of claim 3 wherein at least one of the first microwave components is a directional coupler.

7. The system of claim 3 wherein at least one of the first microwave components is a mode converter.

8. The system of claim 3 wherein at least one of the first microwave components is a filter.

9. The system of claim 3 wherein the central waveguide bore of the first waveguide flange is rectangular in cross-section.

10. The system of claim 3 wherein the central waveguide bore of the first waveguide flange is circular in cross-section.

11. The system of claim 3 wherein the central waveguide bore of the first waveguide flange is oval in cross-section.

12. The system of claim 3 wherein the central waveguide bore of the first waveguide flange is ridged in cross-section.

13. The system of claim 3 wherein the side of the first waveguide flange facing the gasket includes at least one vent trough connecting a volume outside the knife edge to the central waveguide bore.

14. A method for constructing a waveguide flange system, the method comprising:

forming a first waveguide flange on a first microwave component, the first waveguide flange having a central bore, a first weldable weld plate, the first weld plate extending in all directions orthogonal to the central bore, and a first knife edge projecting from the first waveguide flange in a direction parallel to the central bore and surrounding the central bore;

forming a second waveguide flange on a second microwave component, the second waveguide flange having a central bore, a second weldable weld plate, the second weld plate extending in all directions orthogonal to the central bore, and a second knife edge projecting from the second waveguide flange in a direction parallel to the central bore and surrounding the central bore;

placing a deformable gasket between the first waveguide flange and the second waveguide flange, the gasket oriented to contact and engage both the first knife edge and the second knife edge;

tightening a flange clamp assembly to apply a uniform compressive force to the first waveguide flange and second waveguide flange and deform the gasket with the first knife edge and second knife edge to form an RF seal therein;

tack welding exposed portions of the first weld plate to corresponding portions of the second weld plate;

removing the flange clamp assembly; and completing the weld of the first weld plate to the second weld plate to form a vacuum seal therein.

15. The method of claim 14, further comprising:

replacing the flange clamp assembly after completing the weld of the first weld plate to the second weld plate.

* * * * *